United States Patent [19]

Swayze

[11] 4,456,422

[45] Jun. 26, 1984

[54] APPARATUS FOR HANDLING OVAL ARTICLES

[75] Inventor: Kenneth Swayze, Manchester, N.H.

[73] Assignee: Dennison Manufacturing Company, Framingham, Mass.

[21] Appl. No.: 432,235

[22] Filed: Oct. 1, 1982

[51] Int. Cl.[3] ..... B41F 17/22

[52] U.S. Cl. ..... 414/744 A; 101/40; 198/344

[58] Field of Search ..... 101/38 R, 38 A, 39, 101/40, 124, 126; 198/377, 486, 344, 487; 414/744 A, 718

[56] References Cited

U.S. PATENT DOCUMENTS

| | | | |
|---|---|---|---|
| 3,260,194 | 7/1966 | Karlyn | 101/38 R |
| 3,951,271 | 4/1976 | Mette | 414/744 A X |
| 3,968,885 | 7/1976 | Hassan et al. | 198/487 X |

FOREIGN PATENT DOCUMENTS

| | | | |
|---|---|---|---|
| 2060731 | 6/1972 | Fed. Rep. of Germany | 101/40 |
| 2821751 | 11/1979 | Fed. Rep. of Germany | 101/38 R |

*Primary Examiner*—Clifford D. Crowder

*Attorney, Agent, or Firm*—Arthur B. Moore

[57] ABSTRACT

Apparatus for handling articles of oval cross section during silk screen imprinting and the like. An oval article is engaged at top and bottom by carriages, each slidingly mounted along a diameter of a rotating support. The article is conveyed past a screen printing station to imprint a first face, then shifted across the support diameter. The second face of the article is then transported past the screen for imprinting, followed by release of the article for further processing. The timing of the carriage shift is controlled by a pneumatic assembly, and is limited by a pair of adjustable stops according to the radius of curvature of the article.

14 Claims, 15 Drawing Figures

APPARATUS FOR HANDLING OVAL ARTICLES

BACKGROUND OF THE INVENTION

The present invention relates to apparatus for handling bottles and like articles, particularly of a type suitable in the silk-screen imprinting of such articles.

Conventional screen printing apparatus is easily adapted to the imprinting of articles having a circular cross section, in that the uniform radius of curvature is compatible with a continuous screen transfer operation, and permits the rotation of the article to be easily coordinated with the motion of the screen. It is necessary in the screen printing of articles having less symmetric curvatures, that any motion of the screen be coordinated over time with the surface speed of the article being printed. In the case of oval articles, it is also desirable to provide the capability of presenting both faces of the article to the screen. It is additionally desirable that such apparatus be compatible with articles having a wide range of radii of curvature.

U.S. Pat. No. 4,122,768 discloses an attachment which is employed in connection with a screen printer to handle oval articles during imprinting. This apparatus inverts the article between forward and reverse passes of the screen. These article handling functions are effected purely by mechanical means, a characteristic which imposes undesirable limitations on the repetition rate. Furthermore, a number of machine parts must be replaced to adapt the machine to a new article cross section, thereby requiring additional expense when utilizing such apparatus for a variety of articles.

Accordingly, it is a primary object of the invention to provide article handling apparatus which facilitates the screen printing of articles of oval cross section. A related object is to provide apparatus of this nature which permits the imprinting or other processing of both faces of an oval article.

Another object of the invention is to achieve high repetition rates in the handling of oval articles.

A further object of the invention is the provision of article handling apparatus which is compatible with a variety of article cross-sections. A related object is reducing the required part changes in adapting such machines to different articles.

SUMMARY OF THE INVENTION

The article handling apparatus of the invention is intended to facilitate the processing of opposite faces of oval articles. The principal elements of this apparatus are a pair of facing, symmetrically oriented supports which carry assemblies for engaging the top and bottom of oval articles, and for conveying these articles in a circular path; a valve assembly for supplying a pneumatic signal in accordance with the rotational position of the support; mechanical linkage for shifting each article engaging assembly across its support in response to the pneumatic signal; and a drive assembly for rotating the supports. The use of pneumatic control apparatus provides the advantages of adaptability to a variety of article cross sections with minimal part changes, and efficient, high speed operation of the article handling apparatus.

In the illustrated, preferred embodiment, the rotatable support comprises a circular dial. Alternatively, the support may take any form providing adequate structural support for the various associated mechanisms. In accordance with a first aspect of the invention, each article engaging assembly advantageously includes a carriage which is slideably mounted on guide rods so as to be moveable along a diameter of the associated dial. In the preferred embodiment, in which the article comprises a bottle or similar object, one of the carriages supports a member to engage the article base, while the other assembly carries a nose cone. For the silk-screen printing of flexible articles, the nose cone transmits low pressure air to inflate each article during printing. In an alternative embodiment of the invention, a single dial is provided with an article gripping and conveying assembly and valve assembly. In this embodiment, the article is engaged only at one end.

In accordance with another aspect of the invention, the diammetric motion of each carriage is confined by a pair of end stops. The position of these end stops is adjustable by the user in accordance with the radius of curvature of the article faces. The apparatus of the invention requires only this adjustment and possibly the replacement of the base and nose engaging members in order to adapt the apparatus to articles of a variety of configurations.

In a preferred embodiment of the invention, a valve assembly is associated with each support consisting of a spindle secured to the center of the support; a stationary valve block circumjacent the spindle; input air lines to the valve block; an air cylinder; and air lines connecting the spindle to opposite ends of the air cylinder. The spindle rotates adjacent the valve block, thereby causing a pair of conduits within the spindle to intermittently communicate with associated input air ducts in the valve block. Advantageously, one of the conduits receives high pressure air during a first half cycle, while the other conduit receives high pressure air during the second half cycle. This high pressure air is routed through the spindle via the connecting air lines to the air cylinder, so that opposite ends thereof are pressurized during successive half cycles. In the preferred embodiment, a rotary valve arrangement is employed to supply high pressure air to the spindle conduits. In an alternative embodiment, the conduits within the spindle receive high pressure air via a face valve assembly.

In accordance with yet another aspect of the invention, the pneumatically actuated motion of the air cylinder is transmitted to reciprocate the associated carriage through mechanical linkage. The air cylinder may employ a linearly actuated piston rod, or alternatively a rotary actuator. The mechanical linkage may be designed to accommodate a range of carriage travels, so that the apparatus of the invention is advantageously employed in the handling of articles having a range of radii of curvature.

BRIEF DESCRIPTION OF THE DRAWINGS

The above and additional aspects of the invention are further illustrated with reference to the detailed description which follows, taken in conjunction with the drawings in which.

DETAILED DESCRIPTION

Figure 1:
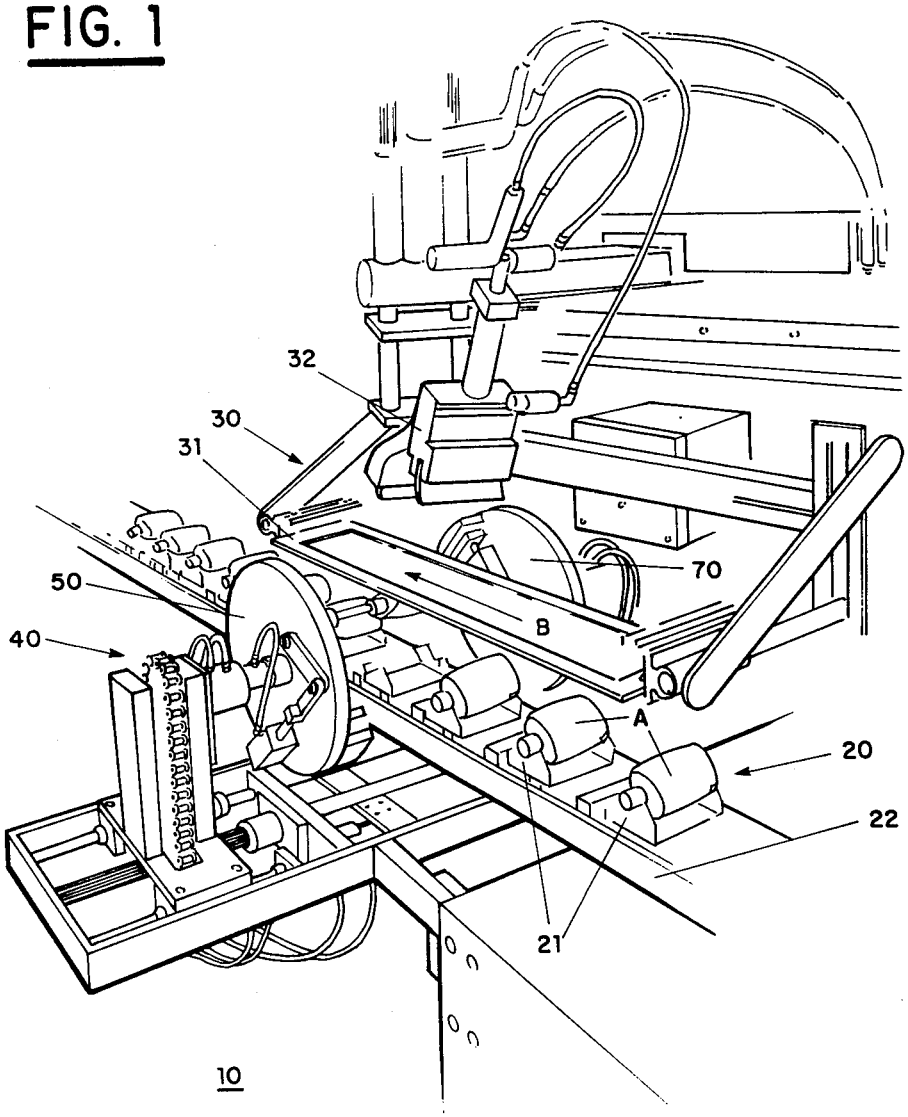
FIG. 1 is a perspective view of the article conveyor and printing area of an illustrative silk-screen printer incorporating bottle handling apparatus in accordance with the preferred embodiment.

The article handling apparatus of the invention is illustrated as incorporated in silk-screen imprinting apparatus, as generally shown in FIG. 1. It should be understood that the invention could be extended to the transport of articles in a variety of processing contexts. Article handling apparatus 40 is particularly suited to the transport of articles of oval cross section, i.e. those having opposite arcuate faces. The apparatus 40 functions to sequentially present each face of an article A to a processing station 30, transporting the article past station 30 at a controlled rate of speed.

As shown in the elevation view of FIG. 1, screen printing apparatus 10 includes an infeed conveyor 20 comprising a series of ware holding receptacles 21 equally spaced on a belt conveyor 22. Articles A are transported by conveyor 20 to article handling apparatus 40 which successively captures each article A and transports the article through a screen printing area 30. In the preferred embodiment, the article handling apparatus 40 comprises a discrete module which may be removed from the screen printing apparatus 10 and replaced with alternative article handling apparatus for imprinting of articles other than the oval articles to which the present invention is particularly suited.

At screen printing station 30, an article A is transported at a controlled rate of speed which is matched to the linear motion in direction B of a screen 31. An article A is imprinted by conventional means well known to skilled artisans using screen 31 in conjunction with a squeegee 32 to deposit an ink image on article A. After imprinting both faces of article A, the bottle handling apparatus 40 releases the article into a waiting receptacle 21 to be conveyed to a drying station or other suitable processing apparatus.

Figure 2:
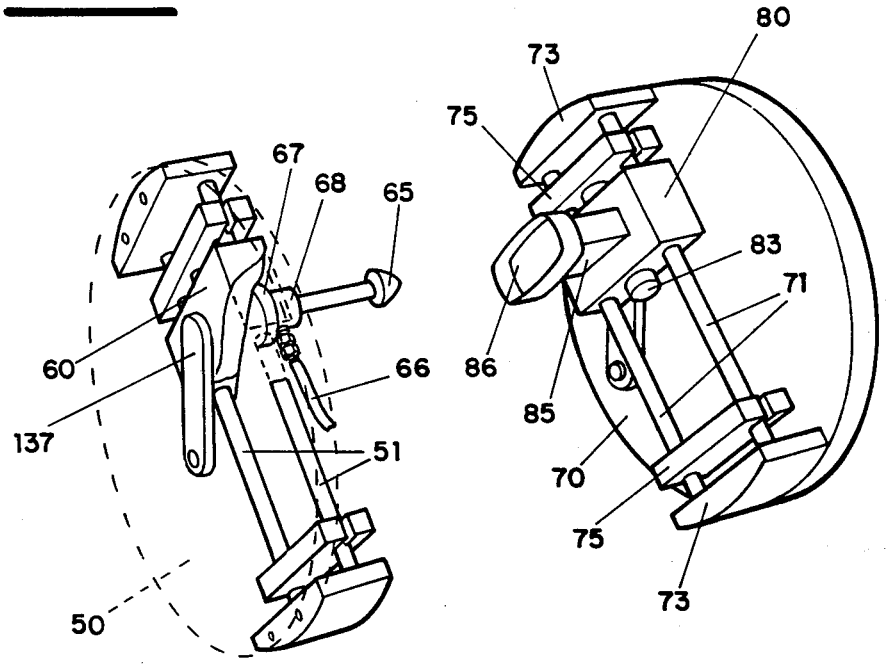
FIG. 2 is a perspective view of bottle handling assemblies for the apparatus of FIG. 1.
Figure 9:
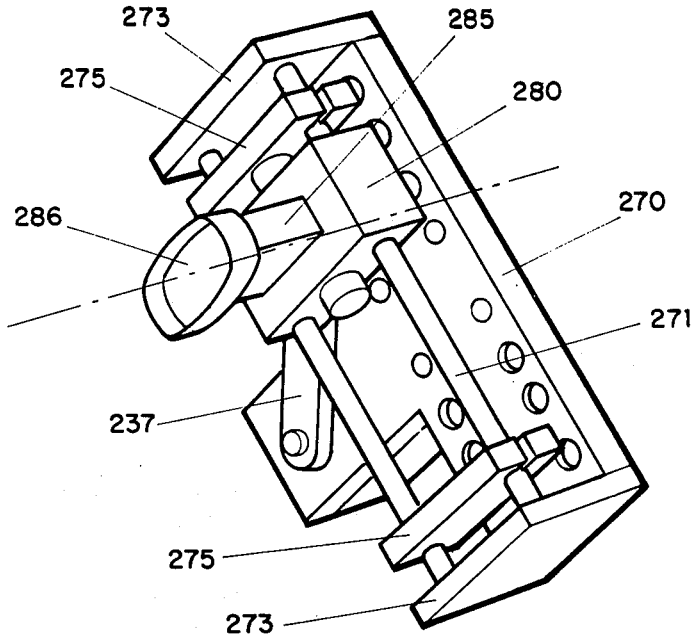
FIG. 9 is a partial perspective view of an alternative bottle handling assembly.
Figure 10:
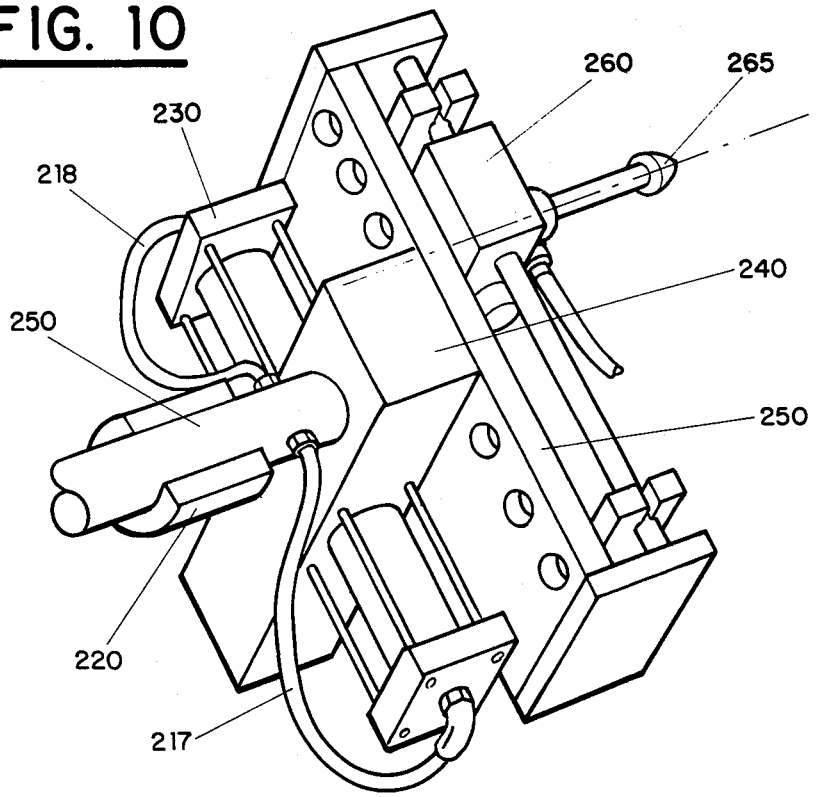
FIG. 10 is a perspective view of the outer face of the bottle handling assembly of FIG. 9, and of the mounting apparatus for this assembly.

With reference to the perspective view of FIG. 1 the article handling apparatus 40 includes a pair of supports dials 50 and 70 with parallel faces bracketing the article conveyor 20. In the preferred embodiment, these supports consist of circular dials. These supports may, however, take any form providing sufficient structural support for the various associated mechanisms. In an alternative embodiment as illustrated in FIGS. 9 and 10, the supports 250 and 270 are more streamlined, T-shaped structures, providing a relatively lightweight assembly. As best seen in FIG. 2, the inner face of each dial houses an assembly for engaging an article A and conveying the article in an arcuate path. Both dials carry essentially identical structures for this purpose, with exceptions noted below, and base dial 70 will be discussed herein for purposes of illustration. With reference to FIG. 2, the base dial 70 supports a pair of diametrically opposite end mounts 73 carrying a pair of parallel guide rods 71. A carriage 80 is slidingly mounted on rods 71. The travel of carriage 80 is limited by a pair of stops 75, which permit the carriage to move until one of its bumbers 83 abuts against the corresponding stop. Advantageously, bumbers 83 and stops 75 consist of a hard elastomeric material. The user may adjust the location of stops 75 on guide rods 73 to define the ambit of carriage travel.

The base carriage 80 supports a pedestal 85 which in turn carries a base chuck 86. Chuck 86 is profiled to snugly engage the base of a given oval article A. The corresponding structures for the carriage 60 of the nose dial 50 comprise a nose cone adaptor 67 over which is fitted a nose cone 65 for a given article A. Low pressure air is fed through an air line 66 into a rotary joint 68, and thence through ducts in nose cone adaptor 67 and nose cone 65. This feature is useful in the screen printing of articles A consisting of flexible plastic or similar flexible materials in order to maintain the shape of the article during printing. In all other respects, the structures on the inner face of nose dial 50 correspond to those mounted on base dial 70. The two dials are oriented so that the base chuck 86 is located opposite nose cone 65. This requires both adjusting the phase relationship so that guide rods 51 and 71 are oppositely aligned, and locating stops 55 and 75 at identical radii.

Figure 7:
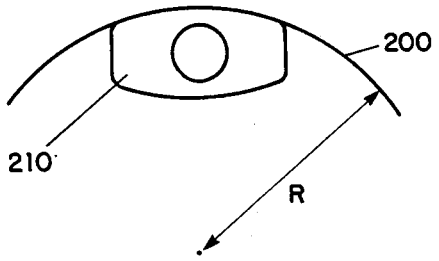
FIG. 7 is a schematic view of an illustrative article cross section, illustrating the geometry of article travel.

With the carriage 80 located at a given extreme established by end stops 75, the rotation of dial 70 will cause article A to describe a circle corresponding to the path of base chuck 86. End stops 75 are positioned by the user so that the circle described by the outer face of article A has a radius corresponding to the radius of curvature of this face. This is schematically represented in the sectional view of FIG. 7, which shows the cross section of an illustrative article A having outer faces 200 and 210.

Figure 3:
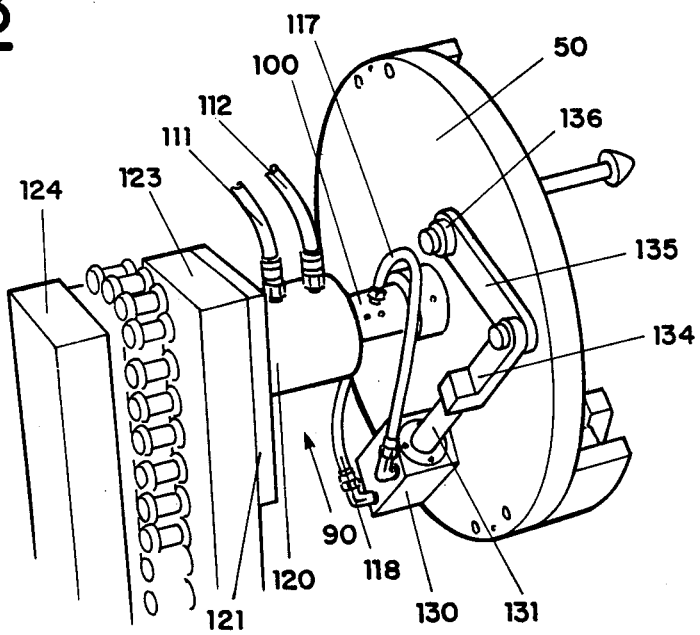
FIG. 3 is a perspective view of the outer face of the nose cone dial of FIG. 1, and of the mounting apparatus for this dial.

As best seen in the perspective view of FIG. 3, the nose cone dial 50 is secured at its center to a spindle 100. Spindle 100 is rotationally mounted in bearings (not shown) in bearing blocks 123 and 124. Spindle 100 and related valving structures 90 operate to pneumatically control the reciprocation of carriage 60. The principal structures in this regard are spindle 100; a rotary valve block 120 which receives high pressure air from air lines 111 and 112; air cylinder block 130 housing an air cylinder 131; and air lines 117 and 118 running from spindle 100 to opposite ends of cylinder block 130. This valve assembly 90, as discussed in detail below, supplies high pressure air to either one end or the other of air cylinder block 130 depending on the rotational position of spindle 100 and dial 50. Essentially identical structures are provided for mounting base dial 70 and for pneumatically controlling the reciprocation of base carriage 80.

The pressurization of air cylinder block 130 determines the pneumatic force exerted on piston rod 131, which is connected to carriage 60 by mechanical linkage to amplify the cylinder stroke by a desired factor in accordance with the desired travel of carriage 60. In the preferred embodiment of FIGS. 1–6, air cylinder 130 linearly actuates piston rod 131, which is further linked to cylinder end 134, pivotally connected to a crank arm 135; crank arm 135 is in turn fixed by a bolt 136 through the dial 50 to a pivot arm 137 (FIG. 2). The pivot arm 137 in turn is rotatably mounted to carriage 60, so that its pivotal motion induces a reciprocation of the carriage. The location of the air cylinder and associated linkage on dial 70 is 180° out of phase with that on dial 50 in order that the linkages will induce the travel of carriages 60 and 80 in parallel.

In the alternative embodiment of FIGS. 9 and 10, the air cylinder 230 is coupled to a rotary actuator 240, which controls the pivotting of pivot arm 237. This apparatus simplifies the linkage to the pneumatic control mechanisms by utilizing a rotary actuator in lieu of a linear piston rod.

The air pressure to air cylinder 131 (and the air cylinder of base dial 70) governs the speed at which the carriages shuttle, and in addition determines the force exerted by each carriage bumber on its end stop (FIG. 2). The use of an air cylinder as the driving mechanism provides a buffer effect which permits using a given air cylinder and linkage for a range of carriage travels. The apparatus of FIG. 3 may be modified for the handling of bottles having very large or very small radii of curvature by appropriately changing the linkage from air cylinder 131 to carriage 60.

Figure 4:
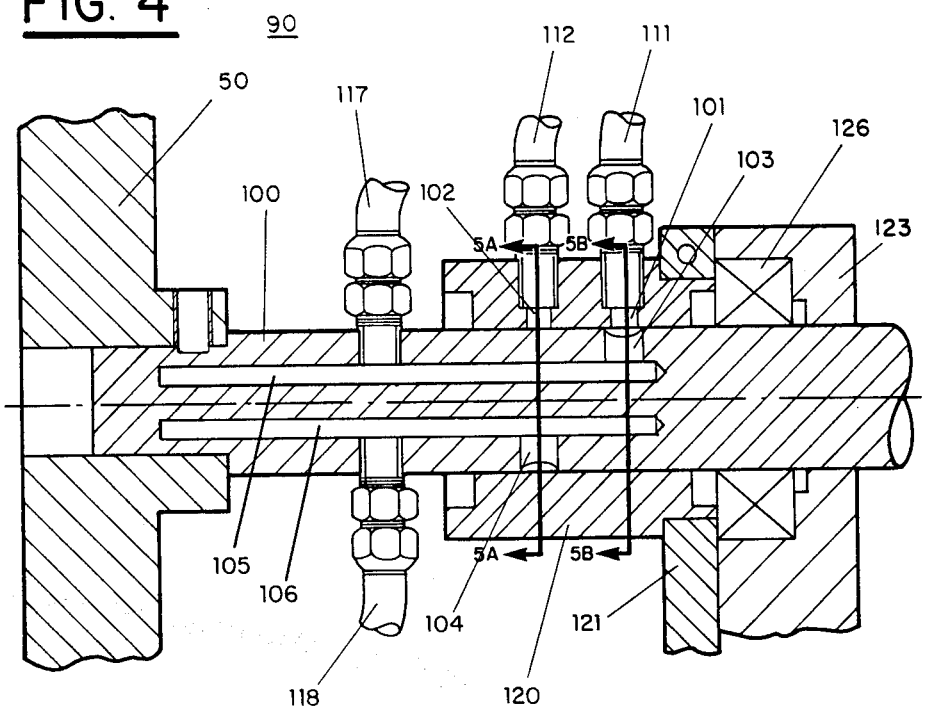
FIG. 4 is an axial sectional view of the valve assembly of FIG. 3.
Figure 5B:
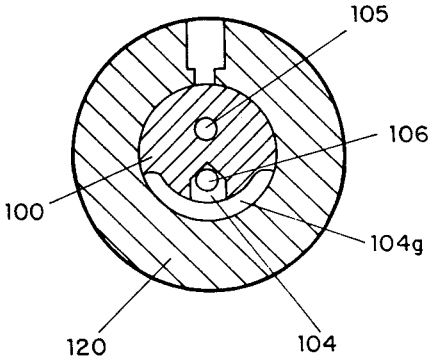
FIG. 5B is a transverse sectional view taken through the lines of 5B—5B in FIG. 4.
Figure 5A:
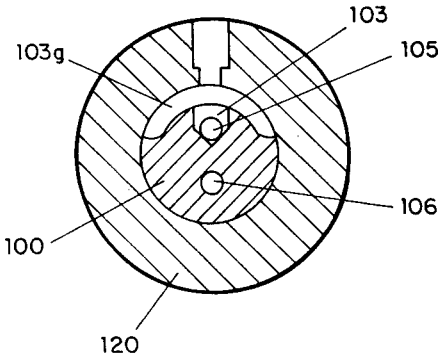
FIG. 5A is a transverse sectional view taken through the lines 5A—5A in FIG. 4.

FIG. 4 shows in section an advantageous design of valve apparatus 90 of the type generally illustrated in FIG. 3. High pressure air is routed through air lines 111 and 112 to input ports 101 and 102 which are drilled through the wall of a stationary valve block 120. Valve block 120 is fixed to a mounting plate 121 which is secured to spindle bearing block 123, while spindle 100 rotates freely with respect thereto in a bearing 126.

Each of ports 101 and 102 intermittently communicate with a corresponding duct, respectively 103 and 104, which connect the periphery of spindle 100 to corresponding central bores 105 and 106. As shown in the transverse sectional view of FIG. 5A, duct 103 terminates at an annular groove **103*g* which encompasses 180° of the periphery of spindle 100. Similarly, as shown in the transverse sectional view of FIG. 5B, duct 104 terminates in an annular groove 104*g* which encompasses a peripheral segment of spindle 100 which is 180° out of phase with the groove 103*g*. Therefore, for any given rotational position of spindle 100 within valve block 120, one of the central bores 105 and 106 will be pressurized, while the other will not. Accordingly, only one of air lines 117 and 118 will be pressurized, so that air cylinder block 130** will be alternately pressurized at one end or the other during successive half cycles.

Although the preferred embodiment of FIGS. 1–6 depicts a rotary valve arrangement to provide pneumatic control of air cylinder 230, other suitable pneumatic valves may be employed. The alternative embodiment of FIG. 10 incorporates a face valve 220 of a type well known in the art; face valve 220 implements the same pneumatic logic as rotary valve 120 (FIGS. 4, 5A, and 5B).

Figure 6:
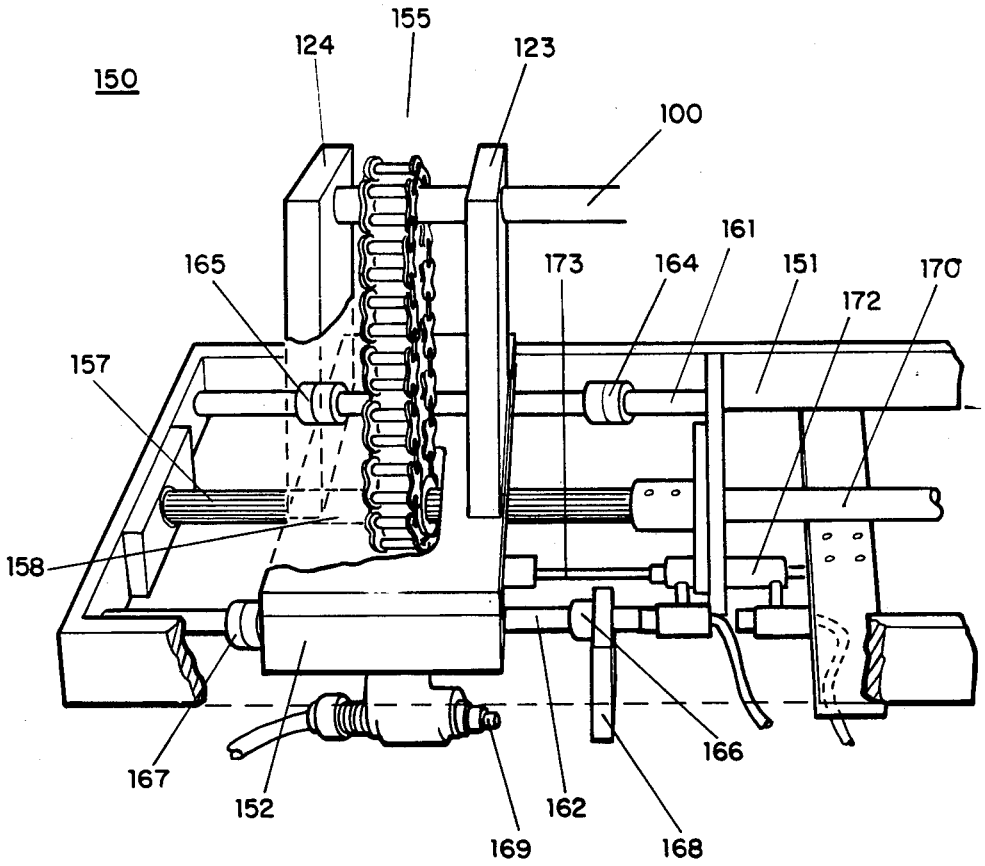
FIG. 6 is a partial perspective view of preferred drive assemblies for the article handling apparatus of FIG. 1.

FIG. 6 shows in a perspective view an advantageous design of an assembly 150 for mounting the article handling apparatus 40 to the remainder of screen printer 10, and for providing a mechanical drive for the various moving parts of apparatus 40. Assembly 150 includes a frame 151, which houses an externally driven shaft 170 toward the rear. Shaft 170 drives a spline 157 which provides the rotational drive input for nose dial 50. Spline 157 is linked to spindle 100 by a sprocket 158 and chain 155; similar mechanisms interconnect drive shaft 170 to the spindle of base dial 70. The use of a spline 157 permits the adaptation of these drive structures to bottles of various lengths.

The nose cone drive structures are mounted on a plate 152 which slides on guide shafts 161 and 162 between end stops 164–167. When an article A arrives on conveyor 20, air cylinder 172 is actuated, inducing the rearward motion of plate 152 and thereby causing the insertion of nose cone 65 into the article A. The location of end stops 164–167 may be adjusted by the user along with the stroke of cylinder 172 to correctly locate nose cone 65 with respect to a bottle of a given length. The air cylinder 172 is actuated in synchronism with the dwell of conveyor 20, and deactuated at the end of the silk-screen imprinting cycle, discussed below with reference to FIGS. 8A–8F. When carriage 152 has reached its rearward position, a shaft collar 168 jogs a mechanical switch 169 to activate the screen printing assembly 30.

Figure 8A:
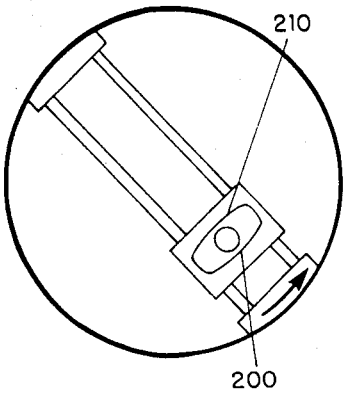
FIG. 8A is a simplified plan view of the inner face of the base dial at the point of initial article engagement.
Figure 8B:
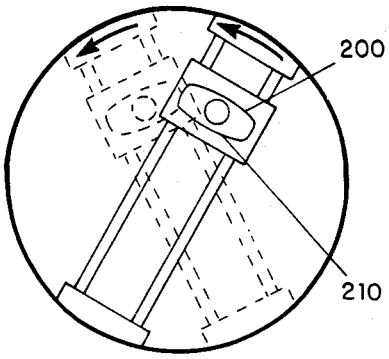
FIG. 8B is a simplified plan view of the inner face of the base dial at the point of the first printing pass.
Figure 8C:
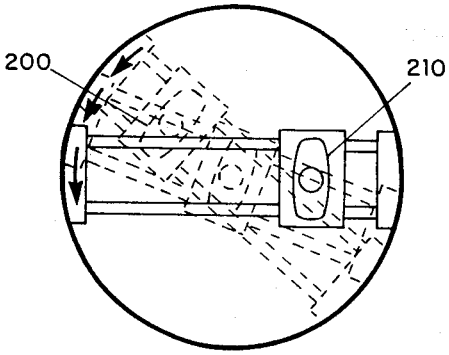
FIG. 8C is a simplified plan view of the inner face of the base dial at the point of the first carriage shuttle.
Figure 8D:
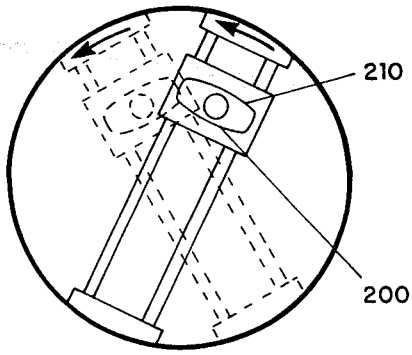
FIG. 8D is a simplified plan view of the inner face of the base dial at the point of the second printing pass.
Figure 8E:
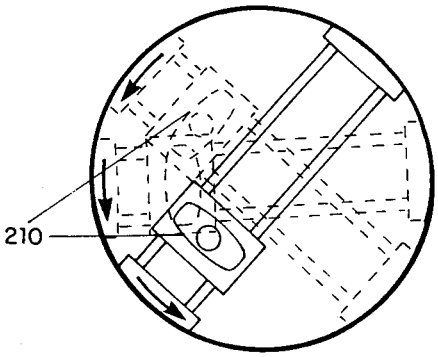
FIG. 8E is a simplified plan view of the inner face of the base dial at the point of the second carriage shuttle.

FIGS. 8A–8E are simplified schematic views of base dial 70, showing the sequence of operation of apparatus 40. In FIG. 8A, the carriage 80 is located nearly at its lowermost position, at which point it engages the base of article A. Dial 70 rotates in a counterclockwise sense, and a first face 200 of article A is conveyed past the screen (FIG. 8B). After this initial printing pass, the carriage 80 is shuttled to a diametrically opposite position (FIG. 8C), followed by a second printing pass to decorate the opposite face 210 of article A (FIG. 8D). The screen 35 advantageously shifts during the interval between these first and second passes in order to impart a new image to the second article face 210. Following the second printing pass, the carriage 80 is again shuttled to a diametrically opposite location as shown in FIG. 8E. Finally, nose cone 67 is withdrawn and the article A is released into a waiting receptacle 25.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims. Although the article handling apparatus of the preferred embodiment incorporates a pair of supports 50 and 70, each bearing corresponding structures to engage and transport opposite ends of an article, it would be sufficient in many applications to utilize a single dial and engage a single portion of an article.

I claim:

1. Apparatus for handling an oval article, comprising:

a rotatable support;

a carriage slidingly mounted to said support to travel along a perpendicular to its axis of rotation;

means fixed to said carriage for engaging a portion of the article;

means for limiting the travel of said carriage between first and second positions; and pneumatic control means, comprising an air cylinder;

a spindle axially fixed to the support, said spindle including a first conduit communicating at an output end wih a first end of said air cylinder, and a second conduit communicating at an output end with a second end of said air cylinder;

a valve block for pressurizing the first conduit during a first angular segment of rotation and for pressurizing the second conduit during a second angular segment of rotation, thereby pressurizing the corresponding end of said air cylinder during each respective angular segment of rotation; and mechanical linkage from said air cylinder to said carriage for biasing the carriage towards its first position during pressurization of the first end of the air cylinder, and for biasing the carriage towards its second position during pressurization of the second end of the air cylinder.

2. Apparatus as defined in claim 1 wherein the support comprises an axially mounted dial.

3. Apparatus as defined in claim 1 wherein the carriage is slidingly mounted on a pair of shafts parallel to a diameter of the support, and wherein the travel of said carriage along said shafts is limited by a pair of end stops.

4. Apparatus as defined in claim 1 wherein said travel limiting means are adjustable to vary the first and second positions.

5. Apparatus as defined in claim 1 wherein the first and second positions of said carriage are equidistant from the axis of rotation, at a distance equal to the radius of curvature of the oval faces of said article.

6. Apparatus as defined in claim 1 wherein the first angular segment of support rotation is complementary to the second angular segment of support rotation.

7. Apparatus as defined in claim 1, for engaging oval articles at opposite ends, comprising a pair of rotatable supports with a common axis of rotation, wherein each rotatable support includes its own carriage, article engaging means, travel limiting means, and pneumatic control means.

8. Apparatus as defined in claim 7, wherein said carriages travel in parallel.

9. Apparatus as defined in claim 7, wherein said rotatable supports have corresponding first and second segments of rotation, whereby the operation of the respective pneumatic control means is synchronized.

10. Apparatus as defined in claim 7, for handling bottles, wherein the article engaging means respectively comprise a chuck to engage the base of the bottle, and a nose cone to engage the nose of the bottle.

11. Apparatus as defined in claim 10, for handling flexible bottles, further comprising a source of low pressure air, wherein said nose cone includes a conduit for routing the low pressure air to the bottle.

12. Apparatus as defined in claim 1 wherein the valve block comprises a rotary valve.

13. Apparatus as defined in claim 1 wherein the valve block comprises a face valve.

14. Apparatus as defined in claim 1 wherein the mechanical linkage provides a given ratio of carriage travel to air cylinder displacement.

* * * * *